US005100076A

United States Patent [19]

Cobane et al.

[11] Patent Number: 5,100,076

[45] Date of Patent: Mar. 31, 1992

[54] FABRIC ROLL

[75] Inventors: Joseph L. Cobane, Grosse Pointe Park; Charles P. Keip, Grandville, both of Mich.

[73] Assignee: Modular Concepts, Inc., Grosse Pointe Woods, Mich.

[21] Appl. No.: 592,824

[22] Filed: Oct. 4, 1990

[51] Int. Cl.[5] ..... B65D 71/00

[52] U.S. Cl. ..... 242/71.8; 206/391; 206/416; 206/503; 403/326; 242/118.6; 242/118.61

[58] Field of Search ..... 242/71.8, 74.1, 118.4, 242/118.6, 118.61; 206/391, 413, 415, 416, 503; 403/326, 378, 379, 108

[56] References Cited

U.S. PATENT DOCUMENTS

| | | | |
|---|---|---|---|
| 930,037 | 8/1909 | Brown | 242/74 |
| 930,327 | 8/1909 | Wheeler | 242/74 |
| T947,001 | 6/1976 | Mavredes | 206/504 |
| 1,187,594 | 6/1916 | Zumvorde | 242/68.5 |
| 1,638,989 | 8/1927 | Duncan | 400/242 |
| 1,875,068 | 8/1932 | Malby | 242/118.61 |
| 1,962,959 | 6/1934 | Kinloch | 242/70 |
| 2,174,049 | 9/1939 | Werner | 24/81 |
| 2,286,500 | 6/1942 | Morrill | 206/59 |
| 2,900,868 | 8/1959 | Gaffney | 242/74 |
| 3,160,356 | 12/1964 | Fisher | 242/18 |
| 3,272,329 | 9/1966 | Mehalov | 206/505 |
| 3,294,225 | 12/1966 | Kenyon | 206/46 |
| 3,356,312 | 12/1967 | Briggs | 242/164 |
| 3,385,678 | 5/1968 | Sorenson | 29/127 |
| 3,390,762 | 7/1968 | Mernieks | 206/59 |
| 3,395,789 | 8/1968 | O'Berry | 206/59 |
| 3,403,780 | 10/1968 | Binkley | 206/65 |
| 3,426,978 | 2/1969 | Barber | 242/74 |
| 3,489,274 | 1/1970 | Hughes | 206/65 |
| 3,495,787 | 2/1970 | Wallace | 242/74.1 |
| 3,593,861 | 7/1971 | Holland | 206/65 R |
| 3,606,002 | 9/1971 | Miller | 206/65 R |
| 3,606,054 | 9/1971 | Miller | 206/65 R |
| 3,814,347 | 6/1974 | Moren | 242/125.1 |
| 4,058,216 | 11/1977 | Tsuyuguchi | 206/391 |
| 4,124,176 | 11/1978 | Carlson et al. | 242/118.62 |
| 4,195,732 | 4/1980 | Bell | 206/391 |
| 4,386,704 | 6/1983 | Maillet | 206/391 |
| 4,416,373 | 11/1983 | deLarosiere | 206/503 |
| 4,435,463 | 3/1984 | Roellchen | 206/391 |
| 4,444,311 | 4/1984 | Rias | 206/391 |
| 4,515,323 | 5/1985 | Rood et al. | 242/71.8 |
| 4,667,823 | 5/1987 | Wolfe | 206/392 |
| 4,773,554 | 9/1988 | Warwick | 206/503 |
| 4,832,196 | 5/1989 | Butler | 206/391 |
| 4,877,133 | 12/1989 | Klenter et al. | 206/416 |
| 4,986,486 | 1/1991 | Kemp | 242/74.1 |
| 4,998,619 | 3/1991 | Sowa | 206/392 |
| 4,253,5702,5 | 3/1981 | O'Connor | 206/391 |

FOREIGN PATENT DOCUMENTS

| | | | |
|---|---|---|---|
| 175983 | 3/1917 | Canada | 242/118.6 |
| 652403 | 3/1929 | France | 242/118.4 |
| 233896 | 5/1925 | United Kingdom | 242/118.6 |
| 433354 | 8/1935 | United Kingdom | 242/71.8 |
| 1174482 | 12/1969 | United Kingdom | 242/71.8 |

*Primary Examiner*—Daniel P. Stodola
*Assistant Examiner*—John Q. Nguyen
*Attorney, Agent, or Firm*—Barnes, Kisselle, Raisch, Choate, Whittemore & Hulbert

[57] ABSTRACT

A roll for fabric or like material includes a core on which the material is adapted to be wound, and an end cap removably secured to each end of the core. The core has a replaceable, flexible flap which extends approximately 90° around the core permitting the leading edge of the fabric or like material to be inserted under the flap so that subsequent turns of the wound material will not show a permanent mark or crease when the second and subsequent turns wrap over the leading edge. The end caps have an undulating pattern along their perimeters which interfit with other end caps when two or more rolls are formed into a module. Modules are combined with top and bottom pallets and bound together for shipment. The cores and end caps are composed of separable parts so that after the material has been removed, these component parts can be separated and combined into a compact package for return to the original shipper.

37 Claims, 18 Drawing Sheets

FABRIC ROLL

This invention relates generally to rolls on which fabric and like material can be wound for storage and/or transportation.

BACKGROUND AND SUMMARY OF THE INVENTION

A roll on which fabric or like material is wound is defined as a core. The cores currently in use are of conventional construction, have a relatively short life and are considered expendable, non-returnable dunnage and are usually discarded after each use. As a result, new cores have to be furnished for replacement and subsequent shipment. However, it is difficult and increasingly expensive to dispose of used cores in an environmentally acceptable manner because of their considerable bulk.

The cores of the present invention, on the other hand, are capable of being used again and again, substantially reducing the cost of replacement and minimizing the problem of disposal. The cores are specially constructed so that when combined with specially designed end caps and wound with fabric and bound together in bundles or modules for shipment, they will interfit securely and without shifting. The cores and end caps are preferably composed of separable parts so that after the fabric or like material has been removed by the intended receiver, these components can be separated and combined into a compact package for return to the original shipper.

It is an object of this invention to provide specially designed cores for fabric and like material, to provide specially designed end caps for the cores, to provide rolls, as defined, composed of a core and an end cap at each end of the core, and to provide modules, as defined, composed of two or more rolls, all having the foregoing advantages. Other objects, features and advantages will become apparent as the following description proceeds, especially when considered with the accompanying drawings.

DETAILED DESCRIPTION

Referring now more particularly to the drawings, and especially to the FIGS. 1-11 thereof, the roll 10 comprises an elongated core 12 and an end cap 14 on each end of the core.

Figure 20:
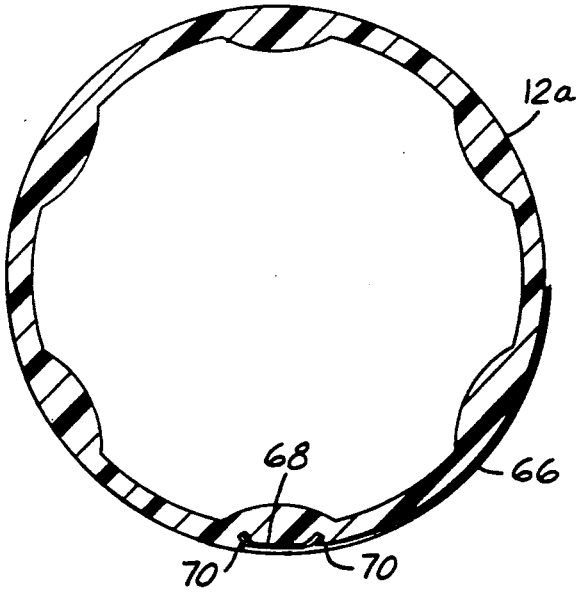
FIG. 20 is a sectional view taken on the line 20—20 in FIG. 19.

The core 12 preferably is in the form of a cylindrical tube of substantially uniform circular cross-section throughout its length. The core may, if desired, have stiffening ribs as shown in FIG. 20.

The end caps 14 are identical, preferably square disks, each having a substantially flat relatively thin body or center 15 and a somewhat thicker rim 17. The edge or periphery of the rim of each end cap has an axially outer peripheral surface portion 16 and an axially inner peripheral surface portion 18, both of which face radially outwardly. These inner and outer peripheral surface portions preferably extend throughout the entire periphery of the end cap in an undulating pattern, each consisting of alternately outwardly bulging and inwardly recessed surface segments 20 and 22. These bulging and recessed surface segments are preferably of arcuate form and blend together in a generally sine-wave configuration. The wave patterns of the two surface portions 16 and 18 are 180° out of phase so that the bulges and recesses of one are respectively opposite the recesses and bulges of the other.

The bulging and recessed surface segments of the outer wavy or peripheral surface portion 16 of each end cap are connected to the recessed and bulging surface segments, respectively, of the inner wavy or peripheral surface portion 18 by linking surfaces 23 which are disposed at a designated angle to the axis of the end cap, preferably less than 90°.

Each end cap has at the center an axially inwardly extending tubular, cylindrical hub 24. When assembled with the core, the hub telescopes within the end of the core and preferably is secured thereto in a manner which permits easy assembly and disassembly.

Figure 1:
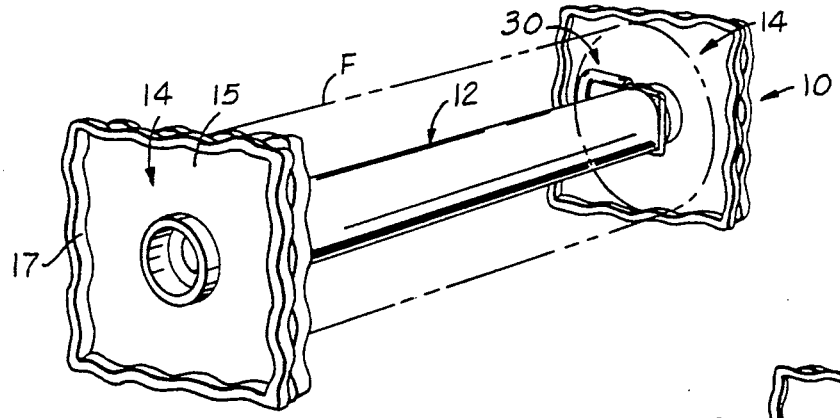
FIG. 1 is a perspective view of a roll constructed in accordance with the invention having a core on which a given width of film or web of fabric or like material may be wound, with end caps releasably secured to the ends of the core.
Figure 2:
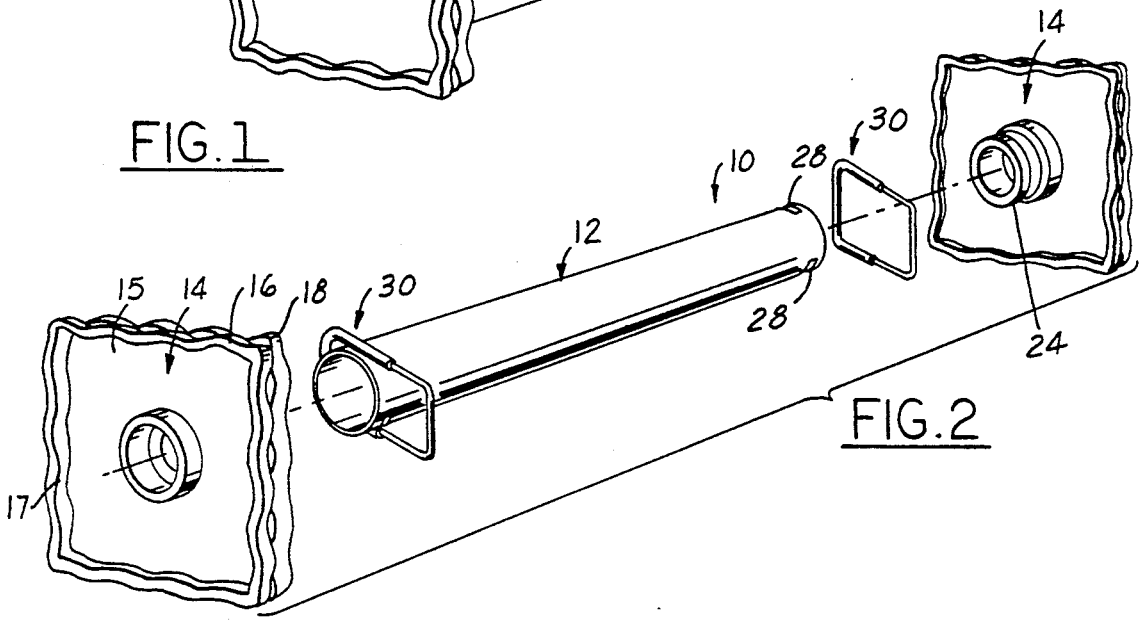
FIG. 2 is an exploded view in perspective of the roll composed of the core and end caps shown in FIG. 1.
Figure 3:
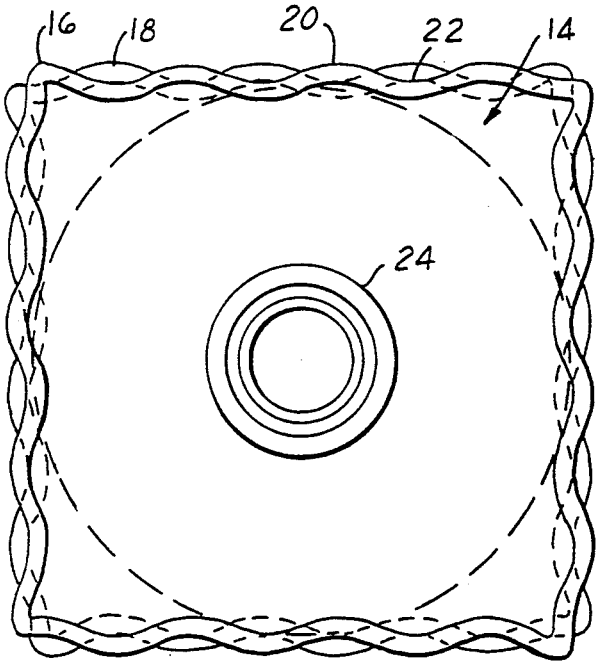
FIG. 3 is an outside elevational view of one of the end caps.
Figure 4:
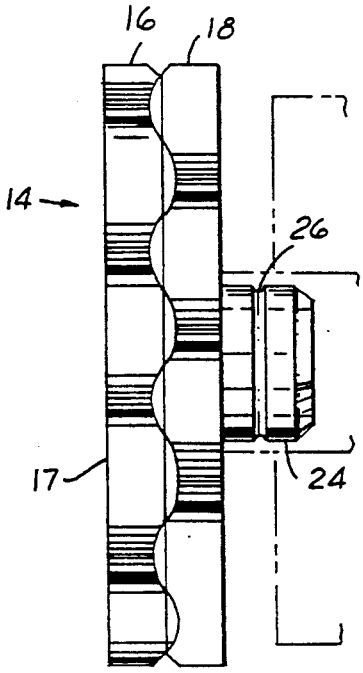
FIG. 4 is an edge view of the end cap shown in FIG. 3.
Figure 5:
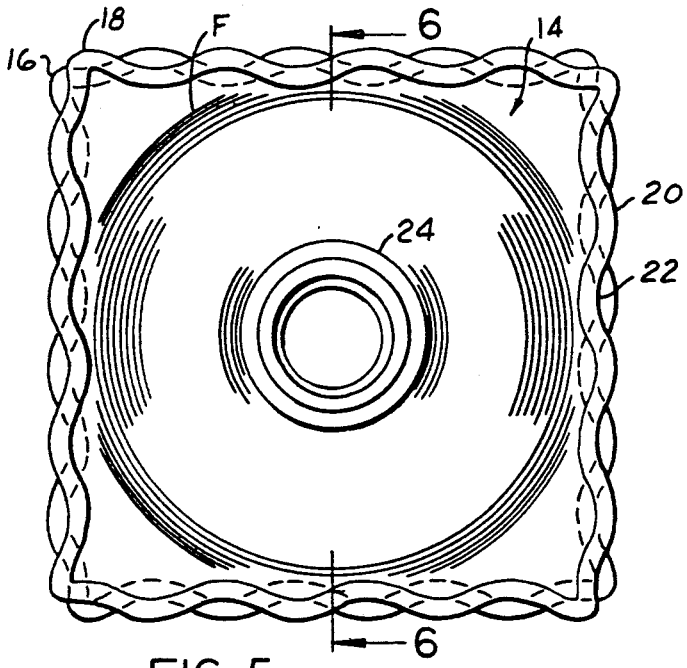
FIG. 5 is an inside elevational view of the end cap shown in FIG. 3.
Figure 6:
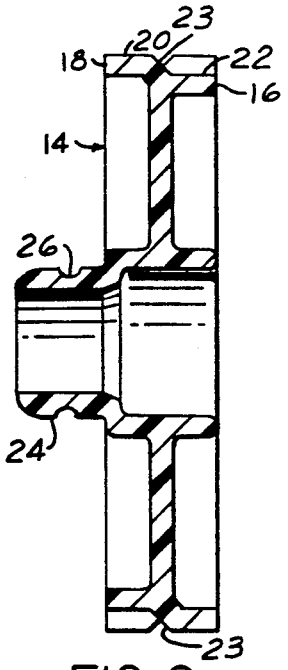
FIG. 6 is a sectional view taken on the line 6—6 in FIG. 5.
Figure 7:
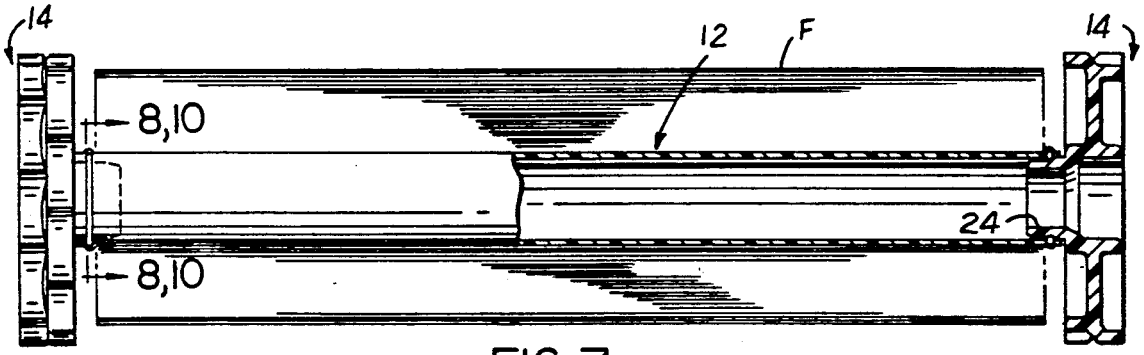
FIG. 7 is an elevational view with parts in section showing the core with a length of fabric wound thereon.
Figure 8:
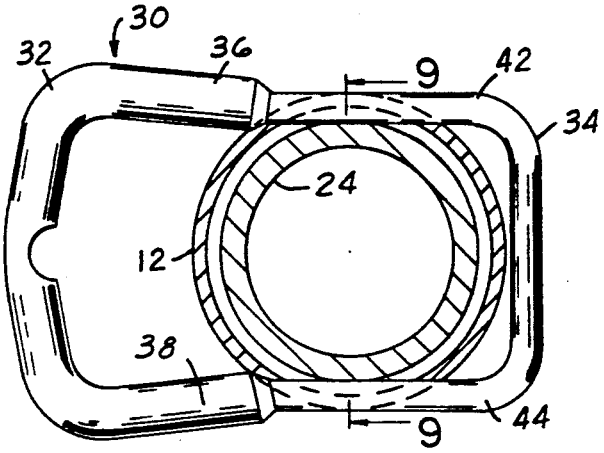
FIG. 8 is a sectional view taken on the line 8—8 in FIG. 7, showing the locking device in the lock position.
Figure 9:
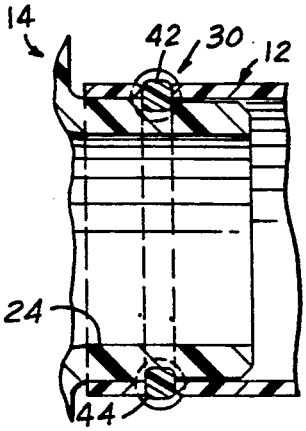
FIG. 9 is a sectional view taken on the line 9—9 in FIG. 8.
Figure 10:
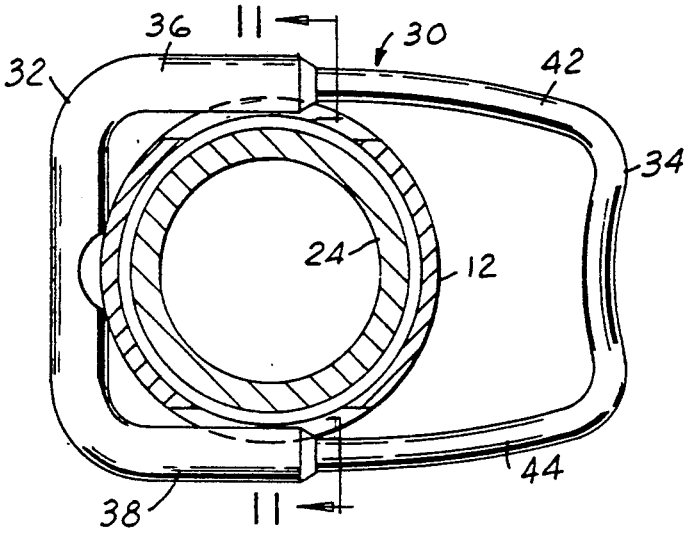
FIG. 10 is a sectional view taken on the line 10—10 in FIG. 7, showing the locking device in the release position.
Figure 11:
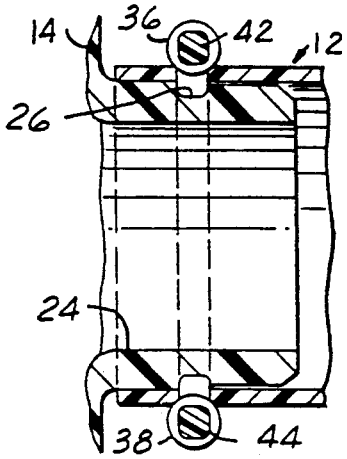
FIG. 11 is a sectional view taken on the line 11—11 in FIG. 10.

As shown in FIG. 6, the hub has an annular groove 26 of semi-circular cross-section in its radially outer surface. The core has near each end a pair of diametrically opposed circumferentially extending slots 28 which, when the hub of an end cap is inserted in the core, register with the groove 26. The width of the slots 28 is preferably the same as the width of the groove 26.

A locking device 30 is provided to releasably secure each end cap 14 to the core 12. The locking device 30 is made of a flexible, resilient material and has two generally C-shaped half sections 32 and 34 connected end to end to form a generally rectangular closed loop. The section 32 has generally parallel legs 36 and 38 of circular cross-section. The section 34 also has generally parallel legs 42 and 44 of circular cross-section, the ends of which connect with the ends of the legs 36 and 38. Legs 36 and 38 of the section 32 are of a somewhat larger diameter than legs 42 and 44 of section 34. More specifically, the width of the legs 36 and 38 of section 32 is greater than the width of the slots 28 in the core, and the width of the legs 42 and 44 of section 34 is substantially the same as the width of the slots 28 and groove 26.

In the normal relaxed or unflexed condition of the locking device, the legs 36 and 38, as well as legs 42 and 44 are spaced apart a distance less than the outside diameter of the core and less than diameter of the groove 26 in the hub.

The locking devices 30 are flexed or stretched to fit over the core. Then with the core 12 inserted in the hub 24 of an end cap and with the core slots 28 registering with the hub groove 26 of the end cap, one of the locking devices is slid along the core until the legs 42 and 44 snap through the slots 28 and into engagement with the groove 26 to releasably secure the end cap on the core (See FIG. 8). The end cap and core can be released by moving the locking device 30 endwise until the legs 36 and 38, instead of legs 42 and 44, move into register with the slots 28 (See FIG. 10). The legs 36 and 38, being wider than the slots 28, do not engage the groove.

Fabric or like material F may be wound on the core of each roll between the end caps thereof.

Figure 12:
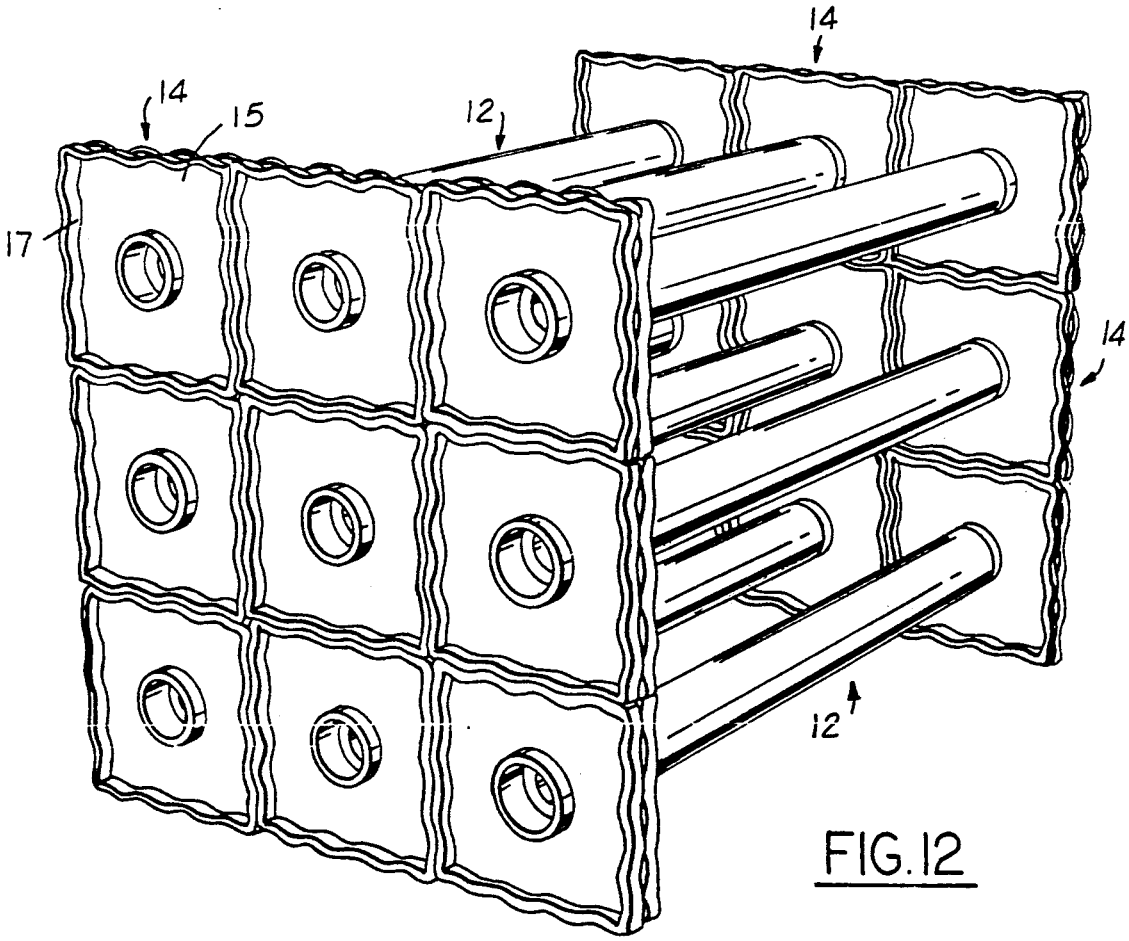
FIG. 12 is a perspective view showing a plurality of rolls grouped together in a module but, for clarity, omitting the fabric wound on the cores and also omitting the top and bottom pallets.

Rolls of film or fabric wound on the core can be brought together into a bundle or module by arranging the wound rolls so that the cores are parallel and are perpendicular to the end caps which are in edge to edge contact. The wavy edge portions 16 and 18 interfit with one another and, being out of phase, prevent longitudinal and lateral shifting. Any number of fabric wound rolls may be bundled or grouped together. For example, a module may be comprised of two rows wide and two rows high of wound rolls or three rows wide and three rows high of wound rolls. The wavy edge portions 16 and 18 along the side edges of adjacent end caps in each row interfit, and the wavy edge portions 16 and 18 along the top and bottom edges of adjacent end caps in adjacent rows interfit. FIG. 12 shows a module of nine wound rolls (three rows with three rolls in each row) but, for clarity omitting the fabric as well as the locking devices releasably securing the end caps on the core and also omitting the top and bottom pallets which will be more fully described hereinafter. The edge-to-edge interfit is clearly shown in FIG. 12.

Figure 13:
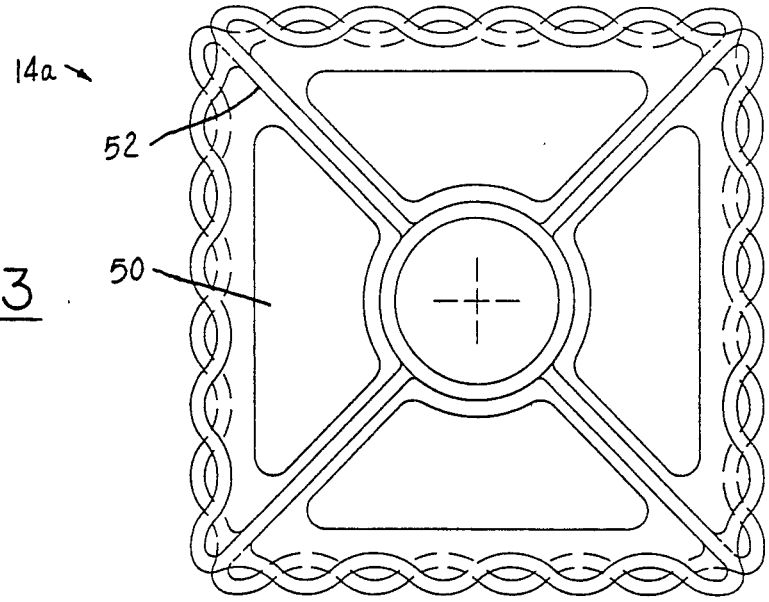
FIG. 13 is a view similar to FIG. 3 showing an end cap of modified construction having reinforcing ribs and weight-reducing clearance openings.

FIGS. 13-17 show end caps of modified construction. The end 14*a* shown in FIG. 13 is substantially like the end cap 14 previously described except that it is formed with openings 50 in the body for the purpose of weight reduction, and also with strengthening ribs 52.

Figure 14:
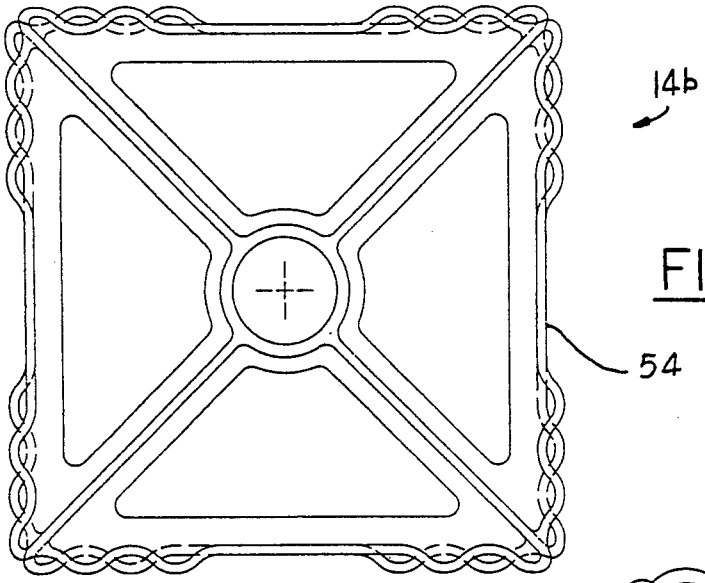
FIG. 14 is a view showing a modified end cap in which the wave form peripheral configuration is interrupted rather than continuous.

The end cap 14*b* in FIG. 14 is like the end cap 14*a* in FIG. 13 except that the wavy undulating sine-wave configuration at the four edges is interrupted intermediate its length, so that there is an intermediate portion 54 along each edge which is straight and flat and without the undulating feature.

Figure 15:
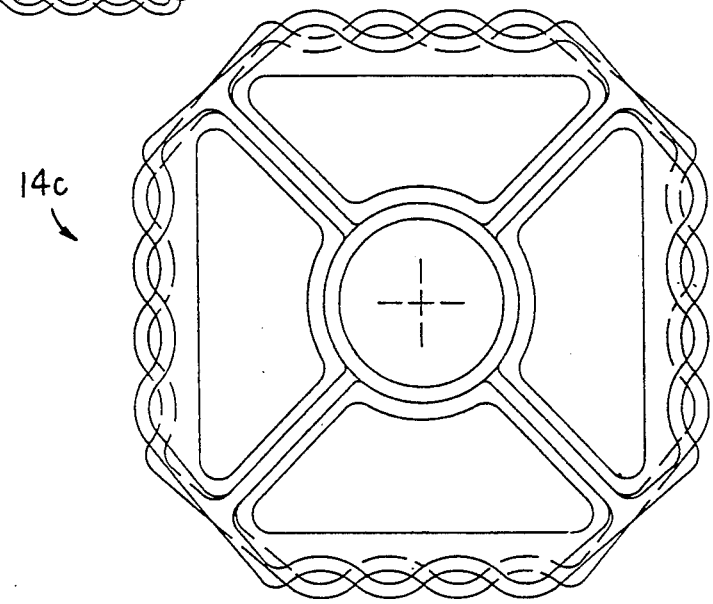
FIG. 15 shows an end cap in which the corners are modified to provide an over-all octagonal configuration.

FIG. 15 shows an end cap 14*c* which is like the end cap 14*a* in FIG. 13 but in which the corners are modified to provide in effect an octagonal figure. Obviously in a module these corners do not make contact with the corners of other end caps, the interengagement of end caps 14*c* occurring only along those sides having the undulations.

Figure 16:
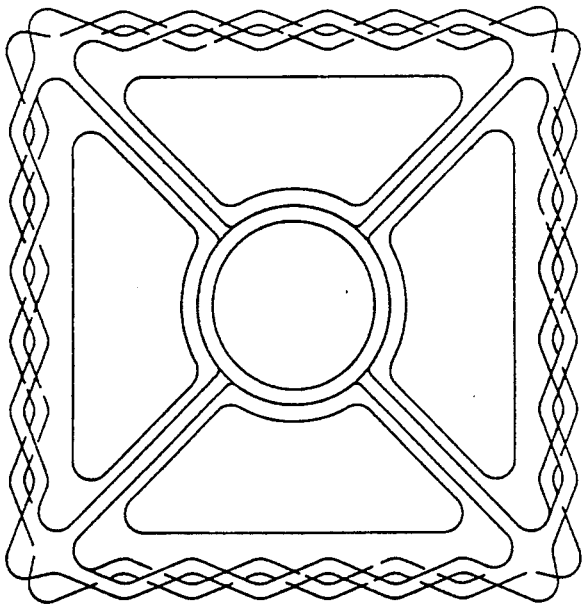
FIG. 16 is a view similar to FIG. 13, but differs in that the undulating configuration along the periphery of the end cap is angular in what might be termed a triangular pattern.

FIG. 16 discloses an end cap 14*d* substantially like the end cap 14*a* in FIG. 13 except that the undulating pattern along the edges, rather than having the sine-wave configuration of FIG. 13, is made of angularly related segments generally triangular in form.

Figure 17:
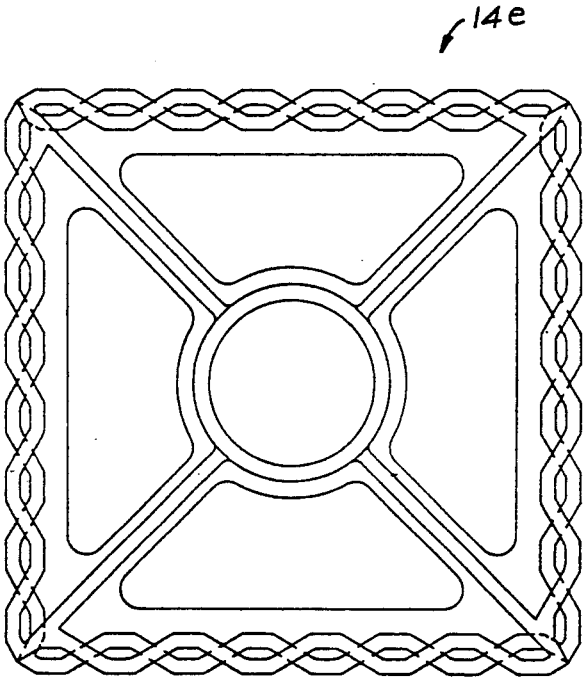
FIG. 17 is a further modification of the end cap in which the peripheral configuration is angular, but in what may be termed a trapezoidal pattern.

The end cap 14*e* in FIG. 17 differs from the end cap 14*d* in FIG. 16 in that the undulating configuration, while also formed of angularly related segments, is truncated or trapezoidal in appearance.

Figure 18:
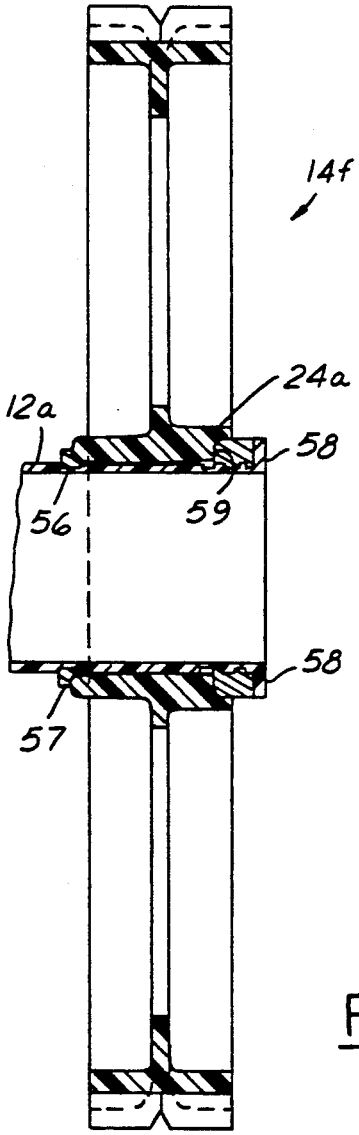
FIG. 18 is a sectional view through one end portion of a roll, in which a modified releasable locking arrangement between the core and end cap is shown.

FIG. 18 shows a modification of the connection between a core 12*a* and an end cap 14*f*. The core 12*a* in FIG. 18 differs from the core previously described in that it is externally threaded at one end and has an annular groove 56 spaced inwardly a short distance from the end. A snap ring 57 fitted in groove 56 projects radially outwardly beyond the circumference of the core. The end cap 14*f* while it may have a peripheral configuration corresponding to that in any of FIGS. 3 and 13–17, has a hub 24*a* of slightly modified form which slips over the end of the core into abutting contact with the snap ring 57. A nut 58 threaded on the end of the core clamps against a recessed portion 59 of the hub to releasably secure the end cap on the core. Another end cap 14*f* obviously may be releasably secured to the other end of the core in like manner by means of a similar snap ring and nut.

Figure 19:
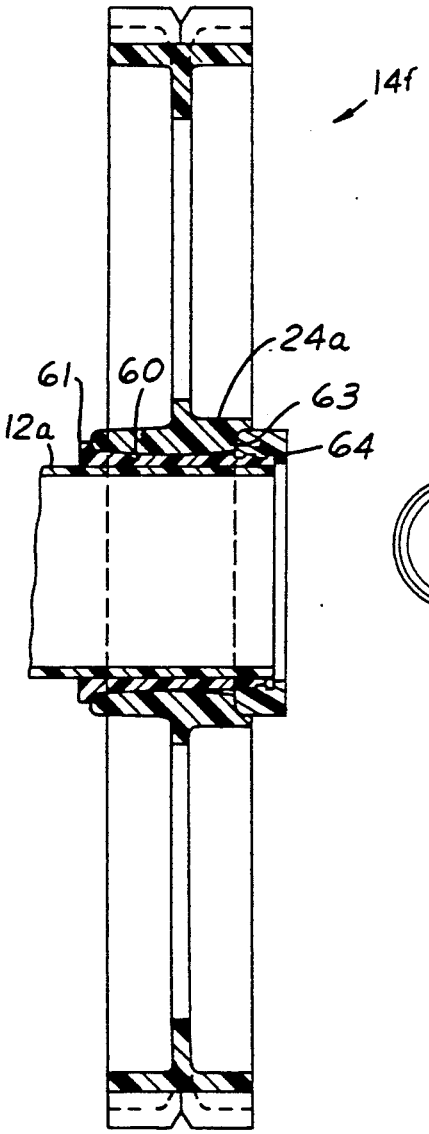
FIG. 19 is a view similar to FIG. 17 but shows a further modification of the locking between the end cap and core.

FIG. 19 is a modification of the releasable connection shown in FIG. 18 in which a collar 60 is welded or otherwise permanently secured to one end of the core. This collar 60 has a radially outwardly projecting abutment 61 at the inner end. The outer end of the collar is externally threaded. A nut 64 threaded on the collar abuts against a recess 63 in the outer end of the hub to clamp the end cap against abutment 61. Clearly the end cap at the other end of the core may be releasably secured thereon by a collar and nut in a similar manner.

In both FIGS. 18 and 19, the connection between the core and end caps is a rotatable connection, permitting the core to rotate while the end caps remain stationary. The rotatable connection facilitates the unwinding of the material from the core.

Figure 19A:
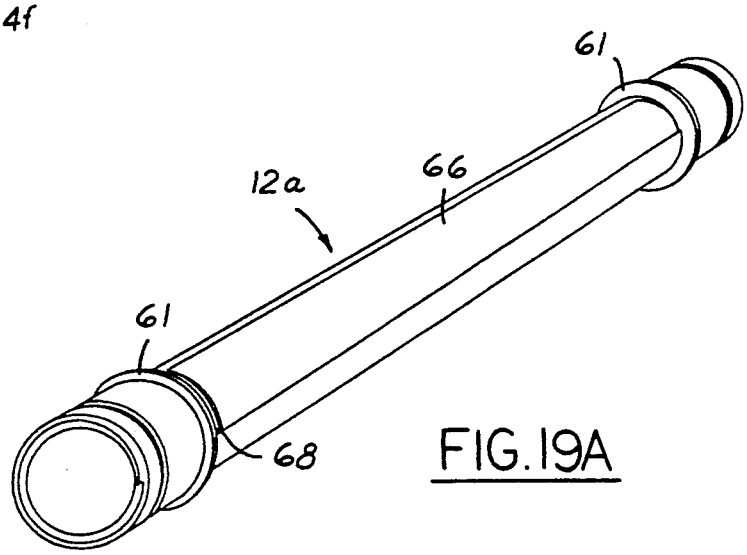
FIG. 19*a* is a perspective view of the core.
Figure 21:
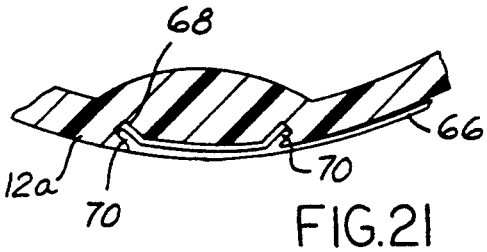
FIG. 21 is an enlargement of a portion of FIG. 20, detailing the attachment of the replacement flap to the core.

The core 12*a* shown in FIG. 19 is of a somewhat different construction between the end caps as shown more clearly in FIGS. 19*a*, 20 and 21. There is a replaceable flexible flap 66 of arcuate form between the end caps which wraps approximately 90° around the core. One longitudinally extending edge of the flap is secured to the core in any suitable manner. In the present instance, the outer surface of the core has a longitudinally extending undercut or dove-tail groove 68 adapted to releasably receive flaring flanges 70 along one longitudinal edge of the flap. These flanges are sufficiently flexible to enable them to be bent enough to be inserted in the groove. The other longitudinal edge of the flap is free of the core and allows the leading edge of a web of fabric or the like to be inserted under the flap so that subsequent turns of the wound fabric will not show a permanent mark or crease where the second and subsequent turns wrap over the leading edge.

As already suggested with reference to FIG. 12, a complete module M preferably includes a top pallet 72 and an identical bottom pallet 73. The pallets are shown in FIGS. 22–35. The pallets are generally rectangular and have on each of the two shorter sides parallel surface strips 74 spaced apart the same distance as the end caps on the ends of each of the cores. The strips 74 on the top and bottom pallets are directly opposed to one another so as to provide for the interfitting end caps within the module. Each pallet has a marginal retaining flange 79 and shoulders 81 along each side. The pallet strips are best shown in FIGS. 22, 23, 24, 25, 28, 29 and 31.

Each of the strips 74 have laterally outer and laterally inner surface portions 82 and 84 (FIG. 23) which extend throughout their full length in an undulating or wavy pattern. These wavy surface portions will have the same pattern as the end caps. In other words, if the rolls have end caps 14, 14*a*, 14*b* or 14*c* with a sine wave pattern, or have end caps 14*d* or 14*e* with the modified triangular or trapezoidal pattern, the strips 74 will have a pattern which matches that of the end caps. The wavy surface portions 82 and 84 on each strip 74 are out of phase 180°, just like the wavy pattern on the edges of the end caps.

The wound rolls are placed on the bottom pallet with the lower edges of the end caps of the bottom row of wound rolls engaging the strips 74. The top pallet is then placed over the wound rolls with the upper edges of the end caps of the top row of wound rolls engaging the strips 74. The module, including the top and bottom pallets, is then bound together by straps or the like as indicated at 86.

Figure 22:
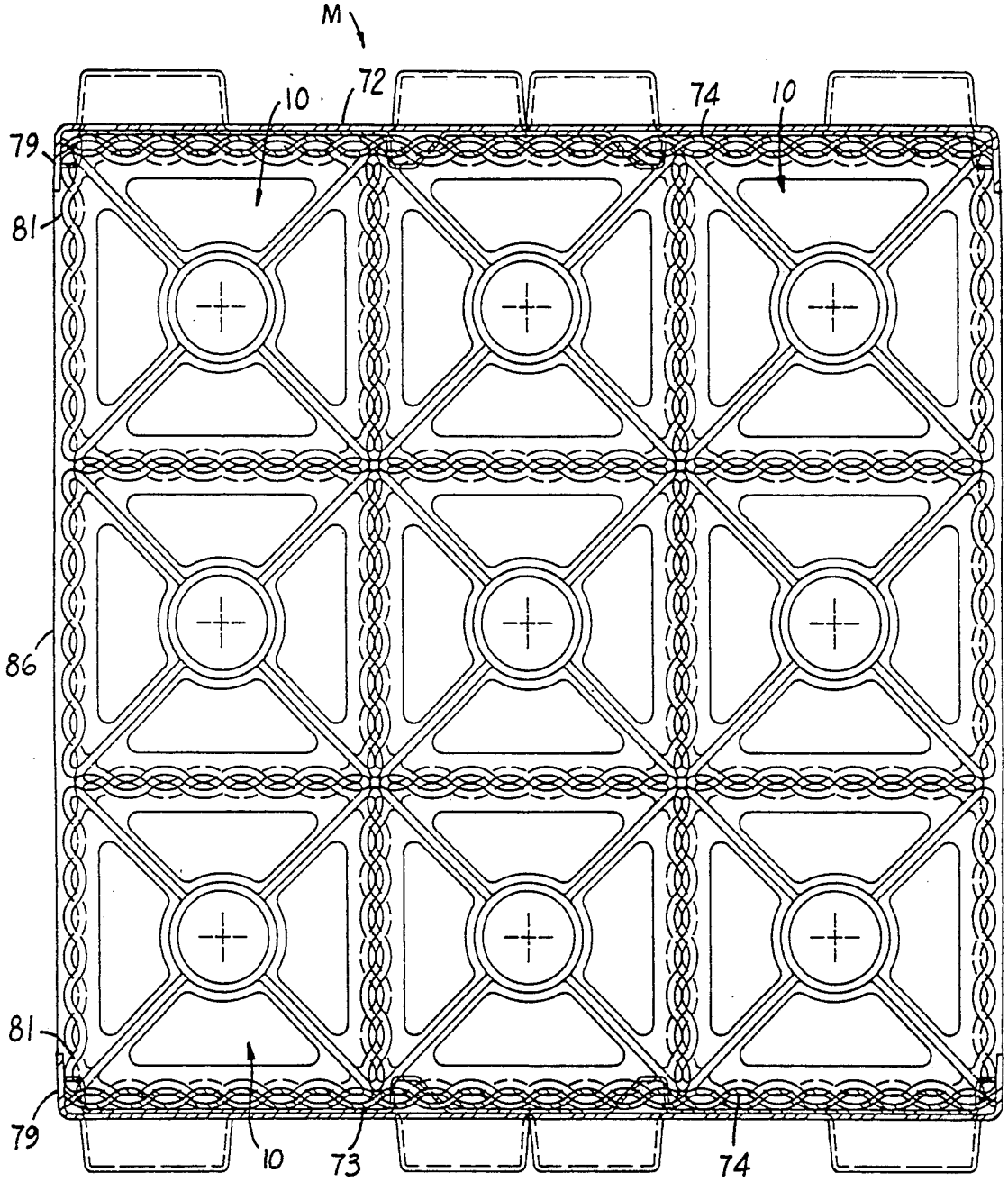
FIG. 22 is an end view showing a complete module of nine rolls comprising nine cores and eighteen end caps, and including top and bottom pallets.
Figure 23:
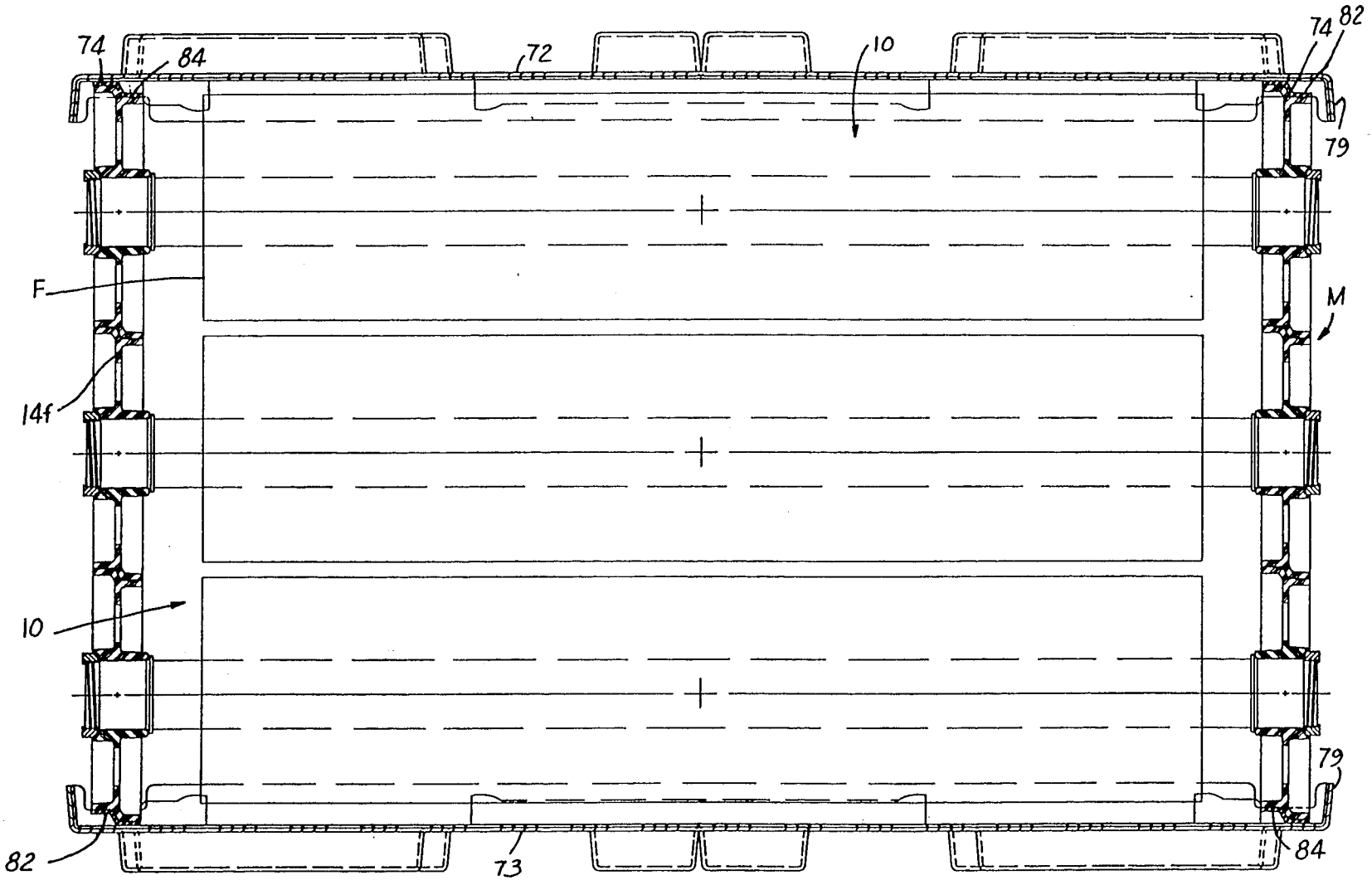
FIG. 23 is a side view of the module shown in FIG. 22.

FIGS. 22 and 23 show a nine wound roll module M consisting of three rows of wound rolls with three rolls in each row, supported on a lower pallet and covered by a top pallet and bound together with straps 86. The wound rolls extend lengthwise of the pallets. The undulating edge portions of the end caps of the wound rolls in the bottom row interfit with the undulating strips 74 along the opposite ends of the bottom pallet. The top pallet fits over the top row of the wound rolls so that the undulating edge portions of the end caps in the top row interfit with the undulating pattern of the strips 74 along the ends of the top pallet. The undulating edge portions of the adjacent caps of all wound rolls interfit with one another. A very stable module is thus provided which restricts the individual wound rolls in the module from moving either in a lengthwise or lateral direction.

Figure 24:
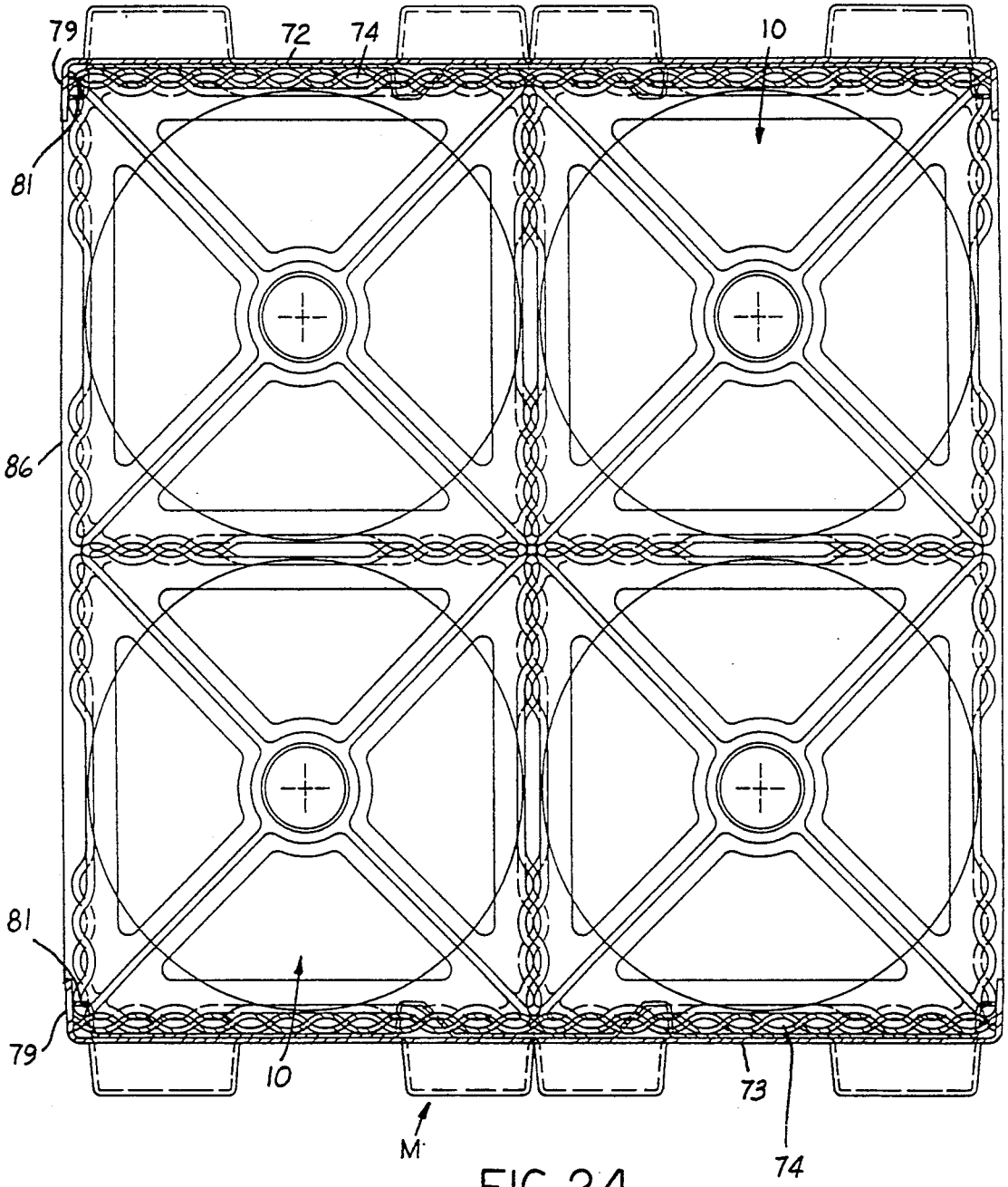
FIG. 24 is an end view of a complete module having four cores and eight end caps and including top and bottom pallets.
Figure 25:
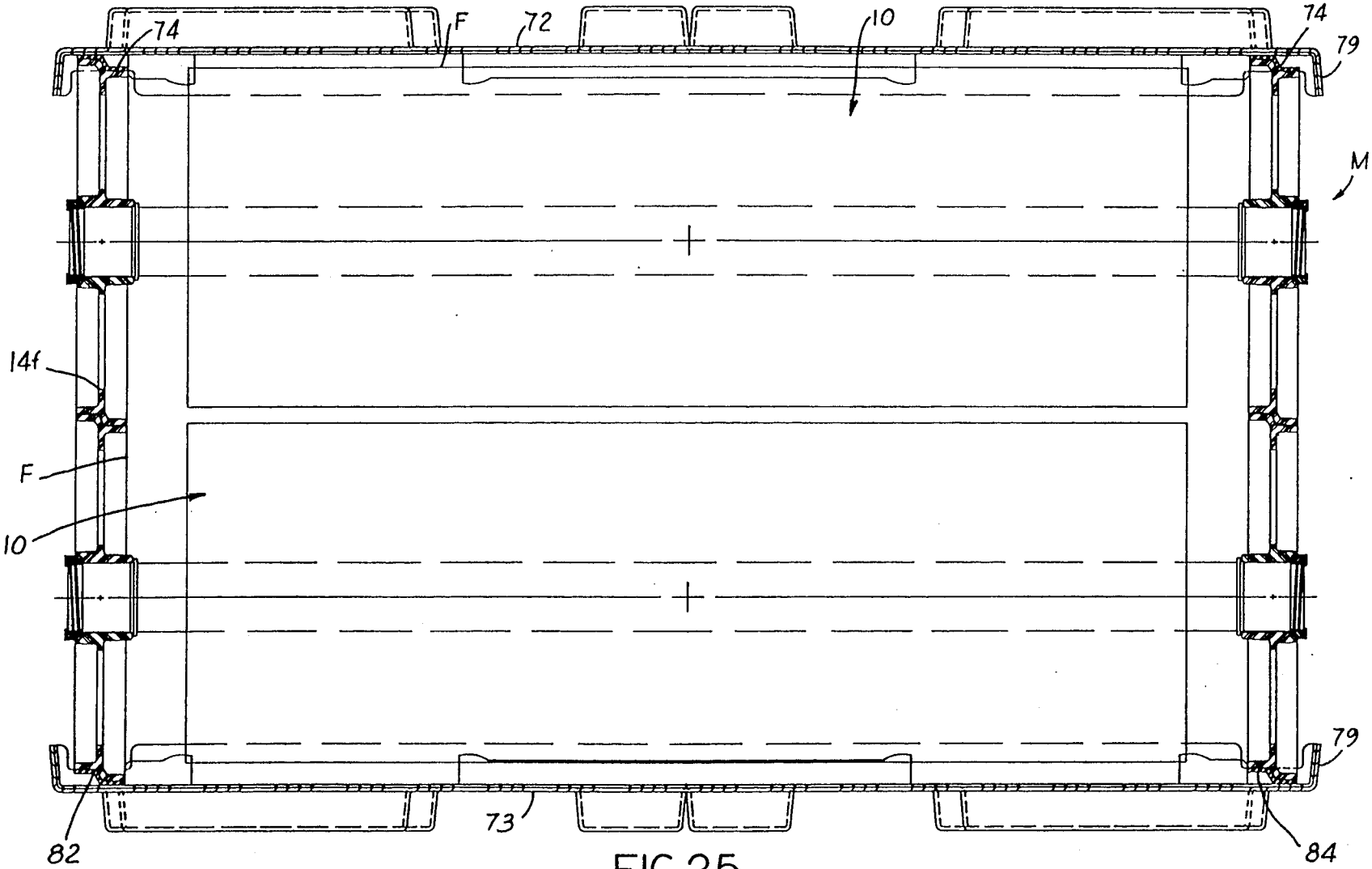
FIG. 25 is a side view of the module shown in FIG. 24.

FIGS. 24 and 25 show a four roll module M with two wound rolls in the bottom row and two in the top row. The wound rolls extend lengthwise of the pallets with the end caps of the four wound rolls interfitting with adjacent end caps and also interfitting with the strips at the ends of the top and bottom pallets. The same pallets used in the nine roll module may be used in the four roll module. The end caps shown in FIGS. 24 and 25 are of the type designated 14*b* and shown in FIG. 14, whereas the end caps in FIGS. 22 and 23 are of the type shown in FIG. 13.

Obviously any of the end caps may be substituted, although in any module all end caps should have the same marginal or peripheral type wave form.

Figure 26:
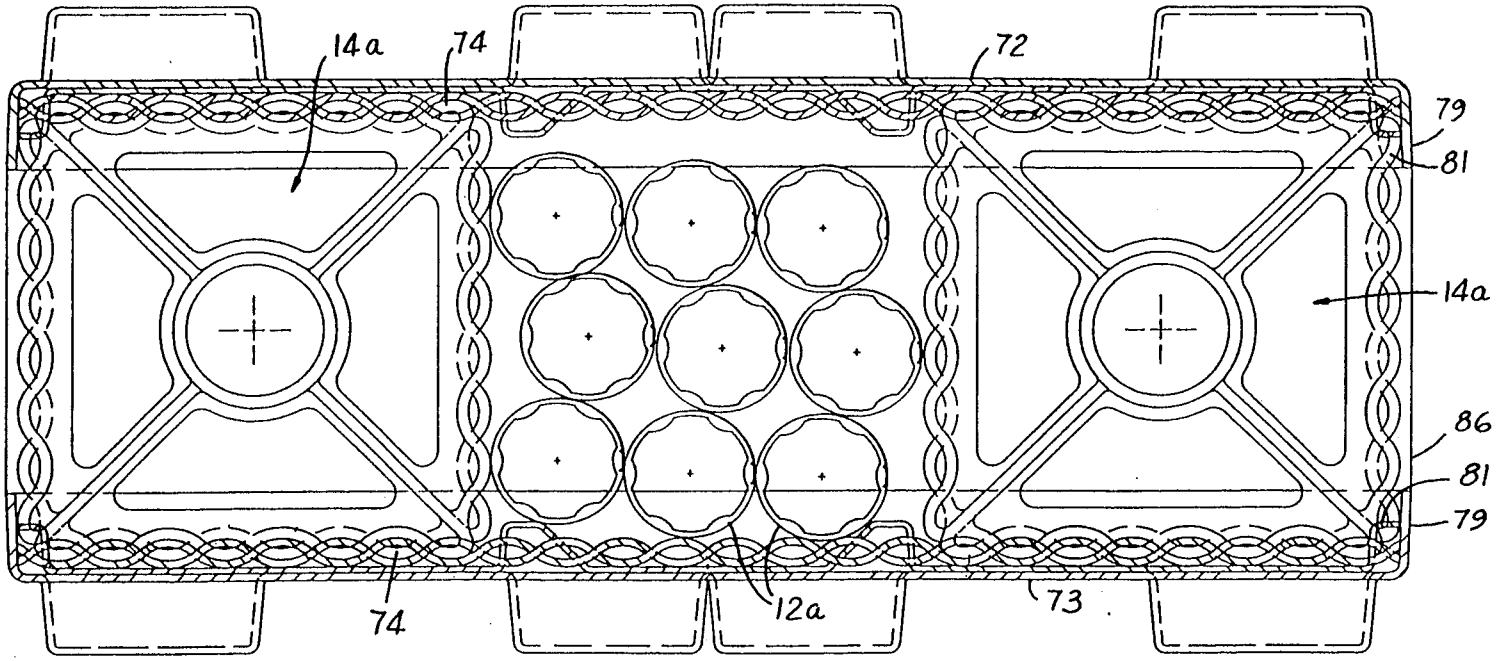
FIG. 26 is a end view of a return package consisting of the separated end caps and cores from a nine core, eighteen end cap module, and their positioning in relation to the top and bottom pallets.
Figure 27:
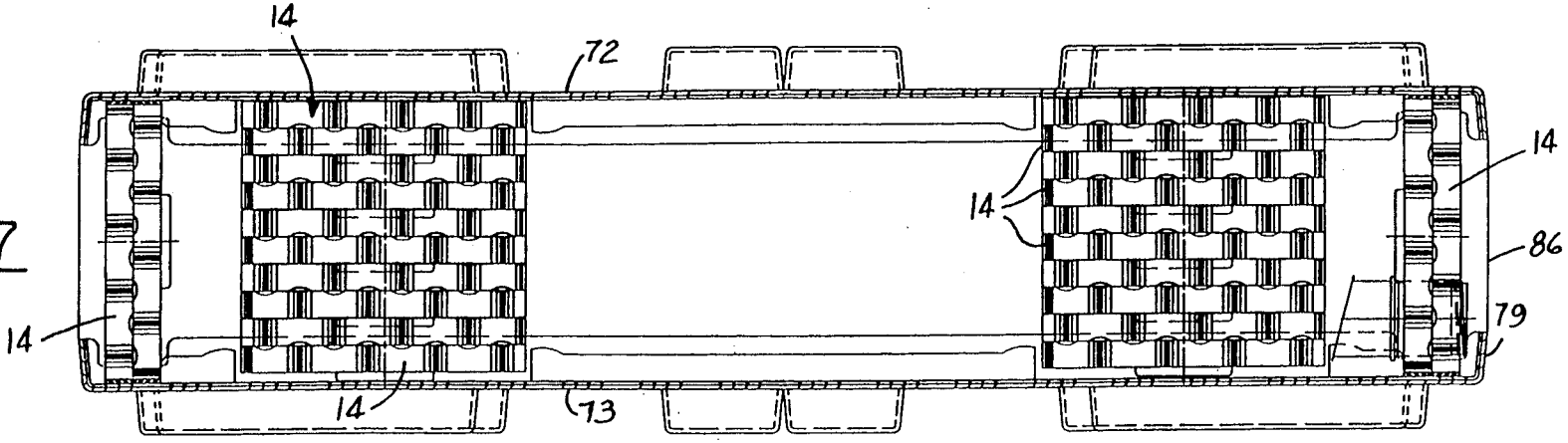
FIG. 27 is a side view of the return package shown in FIG. 26.
Figure 28:
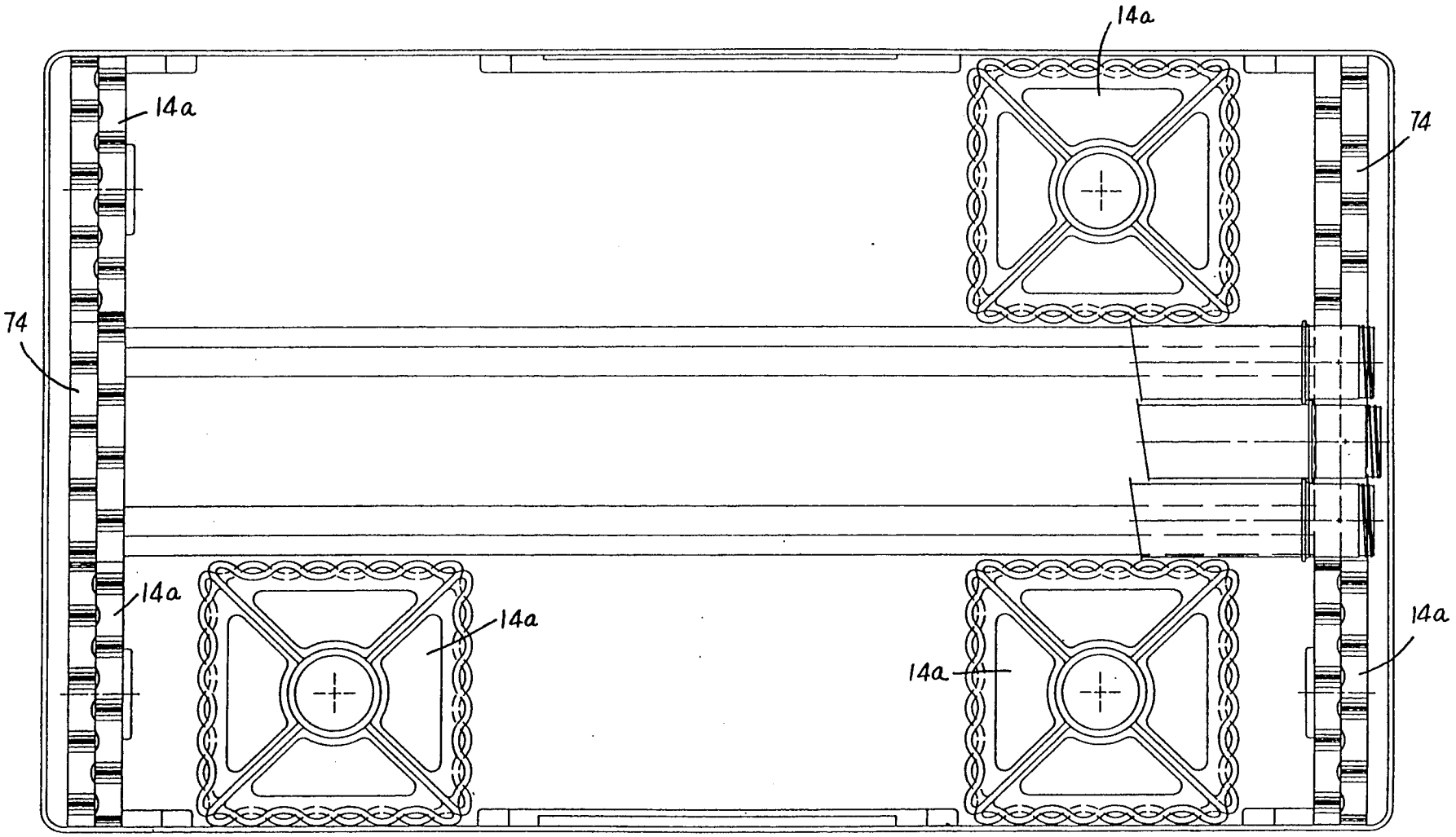
FIG. 28 is a top view of the return package shown in FIGS. 26 and 27, but with the top pallet removed.

FIGS. 26–31 show the return package configuration for the two modules thus far described. In FIGS. 26–28, the return package consists of the separated nine cores and eighteen end caps from a nine roll module. These Figures show one possible distribution of the parts which forms a convenient return package in which the cores extend lengthwise of the top and bottom pallets 72 and 73 approximately midway between the sides and three stacks of five end caps each are positioned upon the bottom pallet in the arrangement best seen in FIG. 28. The three remaining end caps stand on edge with their undulating peripheries in interfitting engagement with the undulating strips at the ends of the top and bottom pallets. Two such end caps are positioned at one end as seen in FIG. 26 and the third end cap is positioned at the opposite end. This return package is bound together with suitable straps. To prevent the top pallet from shifting in a lengthwise direction relative to the bottom pallet, each pallet may have midway in the length of one side edge a panel 90 integrally connected to the pallet by a "living hinge" so that it may be swung into a vertical or operative position projecting towards the opposite pallet into substantial engagement therewith. With one such panel 90 of one pallet and another such panel 90 of the other pallet on opposite sides of the package and swung to the operative position toward the opposite pallet, the pallets and hence the entire package is stabilized.

Figure 29:
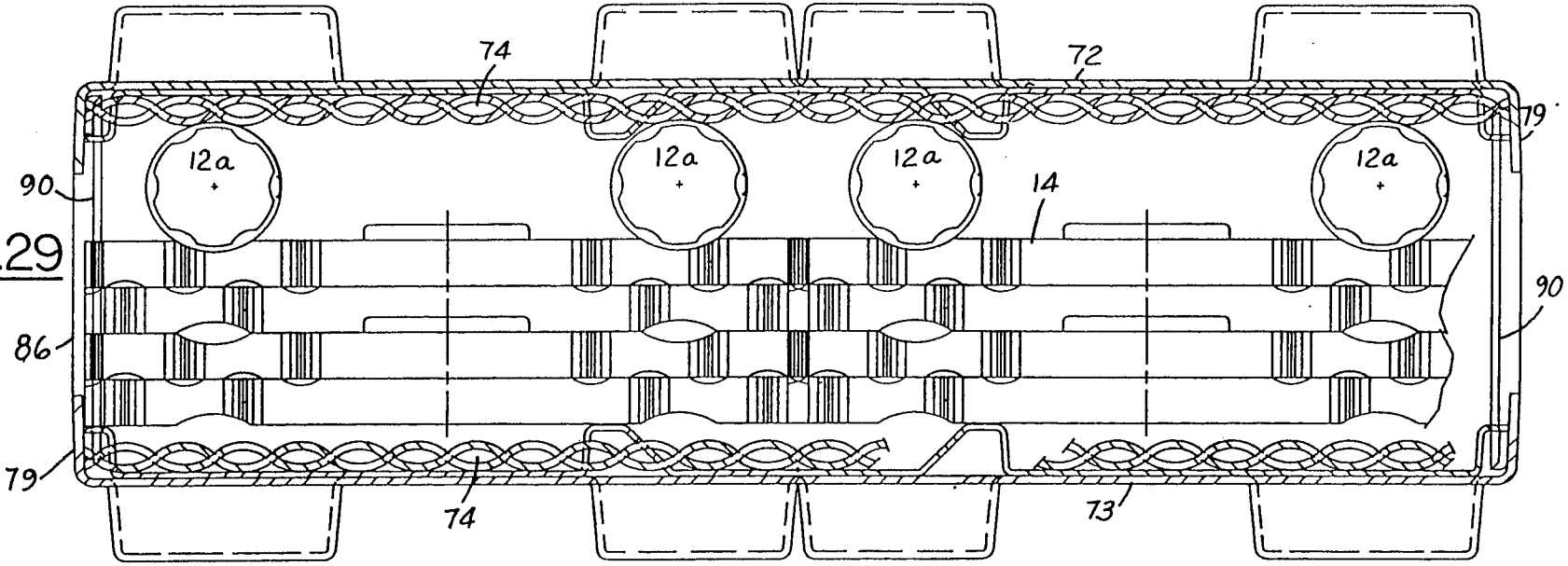
FIG. 29 is an end view of a return package consisting of the separated end caps and cores of a four core, eight end cap module and their positioning in relation to the top and bottom pallets.
Figure 30:
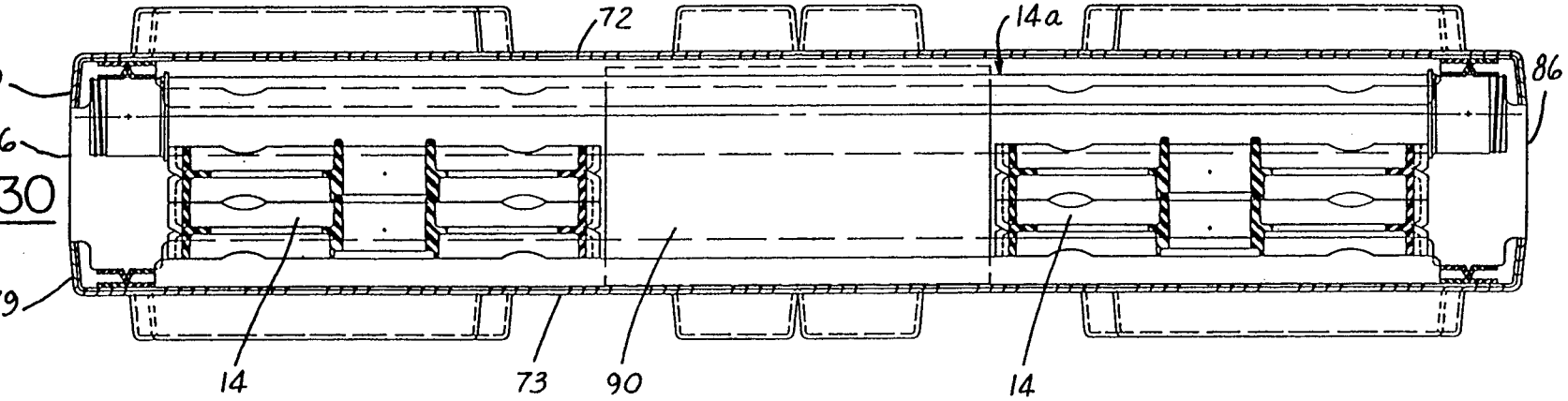
FIG. 30 is a side view of the return package shown in FIG. 29.
Figure 31:
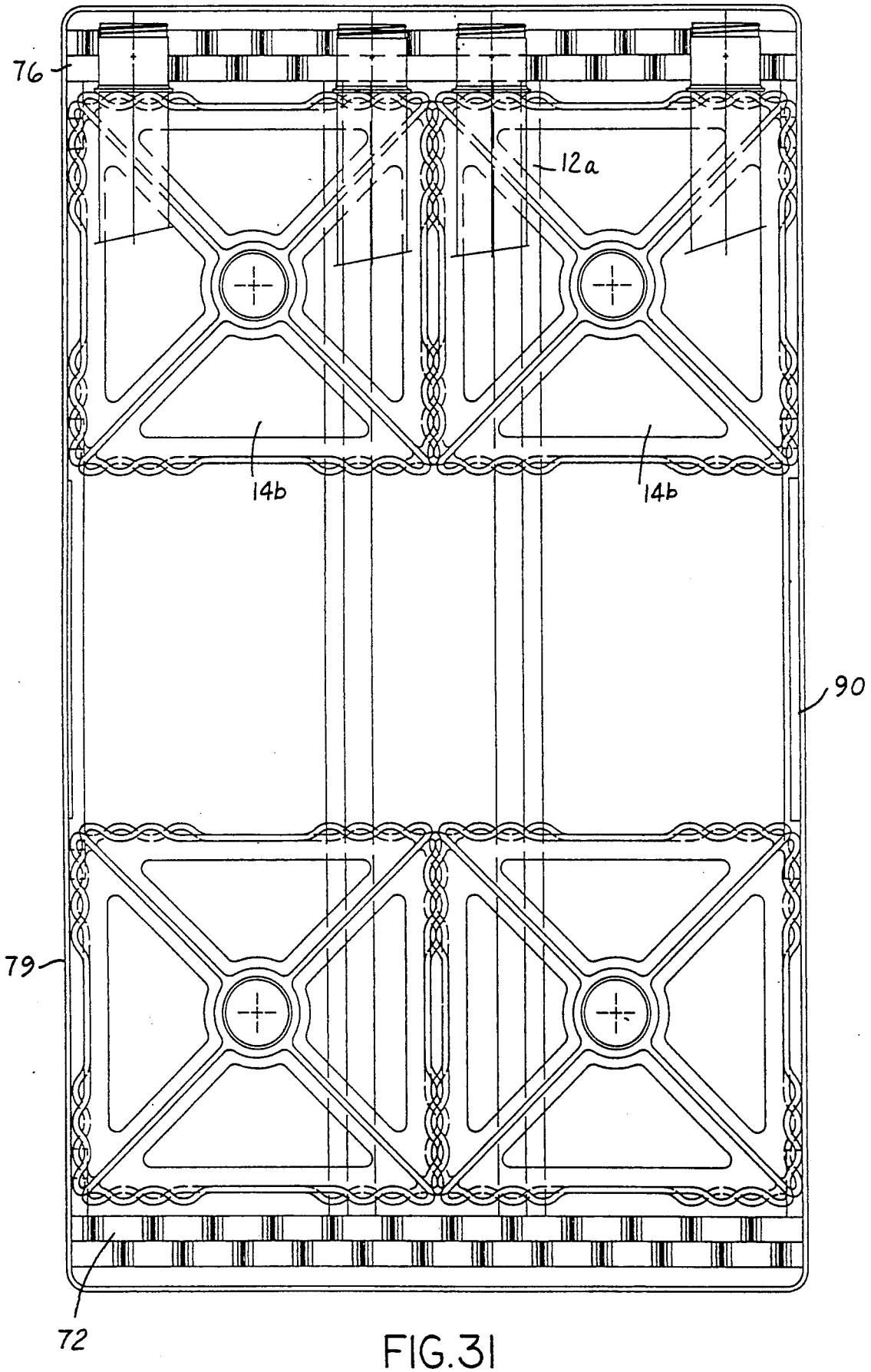
FIG. 31 is top view of the return package shown in FIGS. 29 and 30 with the top pallet removed.

The return package for the separated parts of the four roll module is shown in FIGS. 29–31 in which the eight end caps are disposed upon the bottom pallet in four stacks of two each, with two stacks adjacent one end of the pallets and two stacks adjacent the other end and with the edges of the end caps in adjacent stacks having their undulating margins or peripheries interfitting. The four cores are laid lengthwise of the lower pallet upon the four stacks of end caps. The upper pallet subsequently is placed over the assembly of end caps and cores and the entire return package bound together with suitable straps 86.

Figure 32:
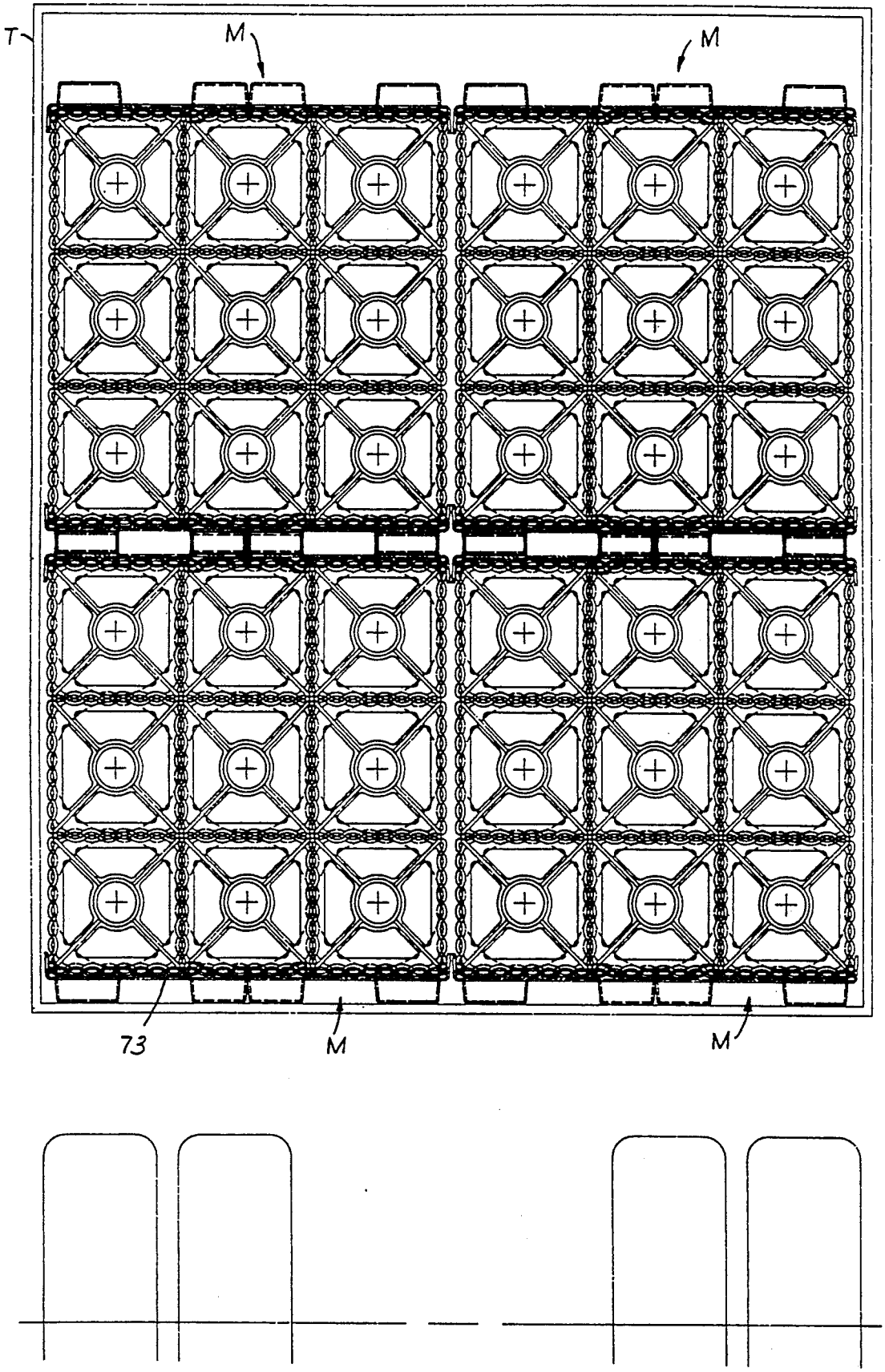
FIG. 32 is an end view showing four nine roll modules supported on the bed of a standard truck-trailer.

FIG. 32 shows four nine roll modules supported on the bed of a truck-trailer T having wheels W. These modules are arranged in two stacks side-by-side with two modules in each stack and with the bottom pallet of the upper module in each stack resting upon the top pallet of the lower module. After the fabric or the like is removed from the cores and the cores, end caps and pallets are formed into return packages, it will be seen in FIG. 33 that these return packages are reduced sufficiently in size that ten of them may be supported on the truck. While these modules and return modules in FIGS. 32 and 33 illustrate only two side-by-side stacks, it will be understood that additional stacks may occupy the space either to the rear or the front of the stacks shown, depending upon the length of the truck body.

Figure 33:
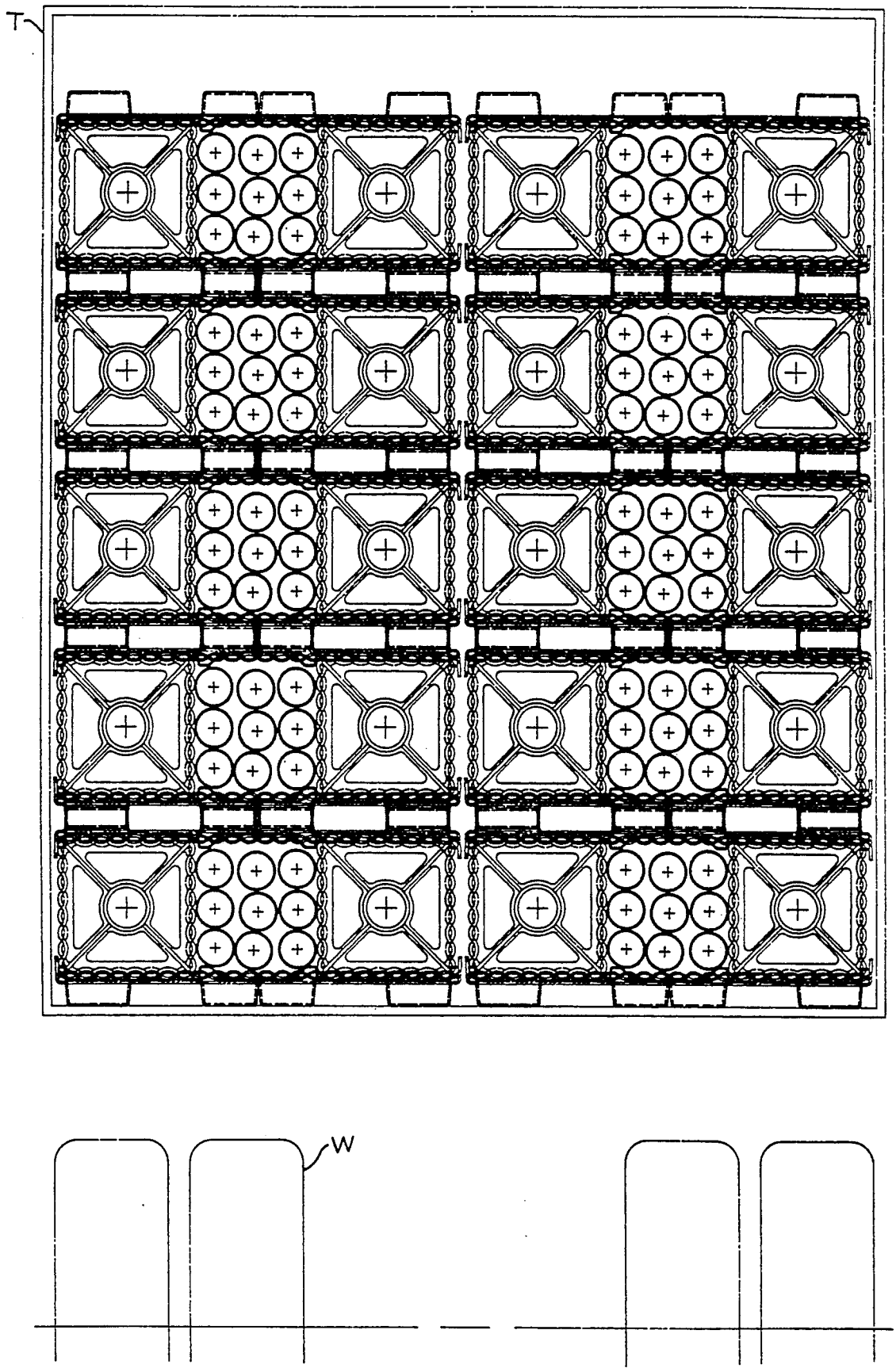
FIG. 33 is a view similar to FIG. 32 but shows that the same truck-trailer is capable of returning ten of the empty nine core modules per tier.
Figure 34:
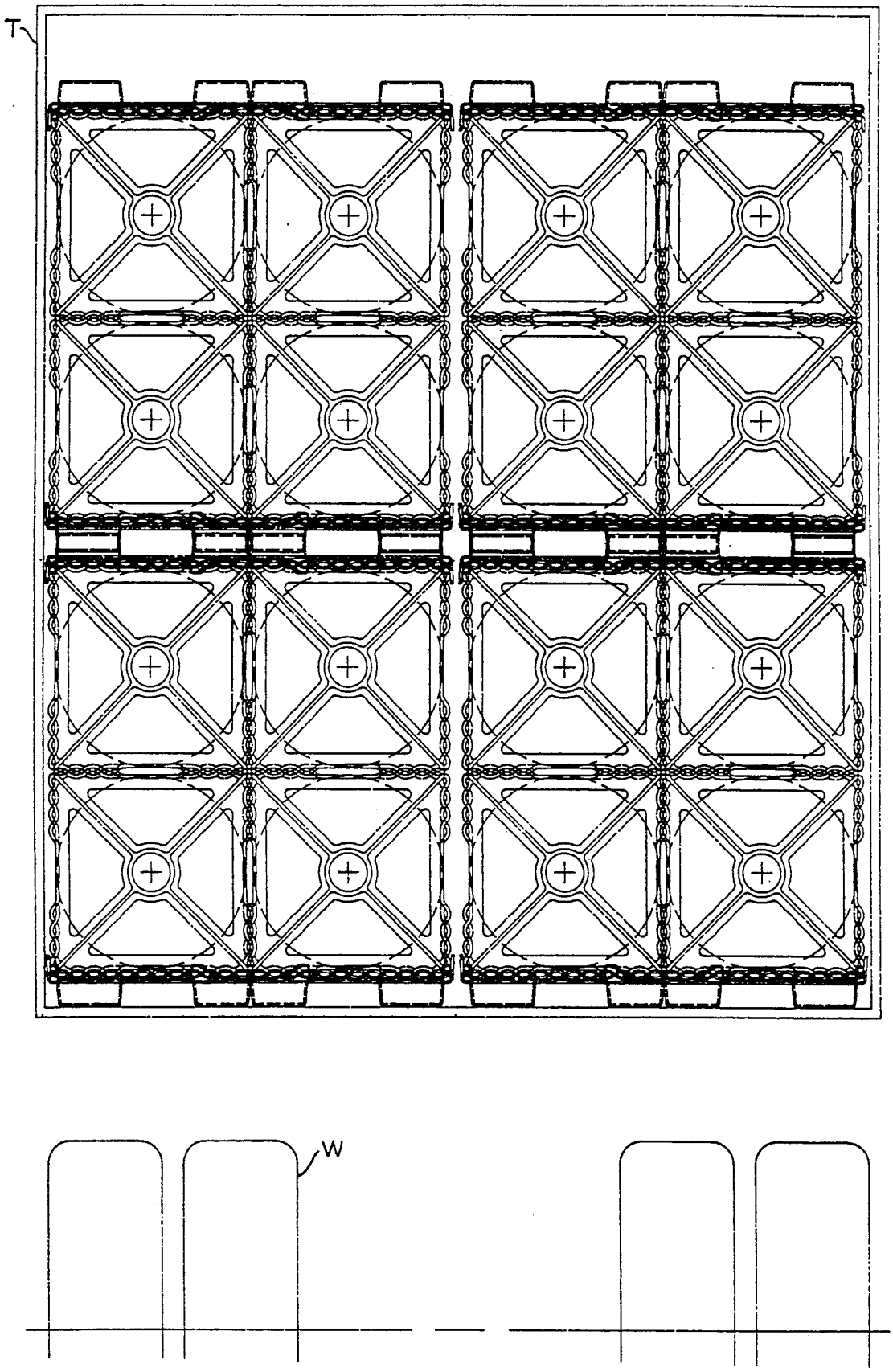
FIG. 34 is an end view showing four four roll modules supported on the bed of a standard truck-trailer.
Figure 35:
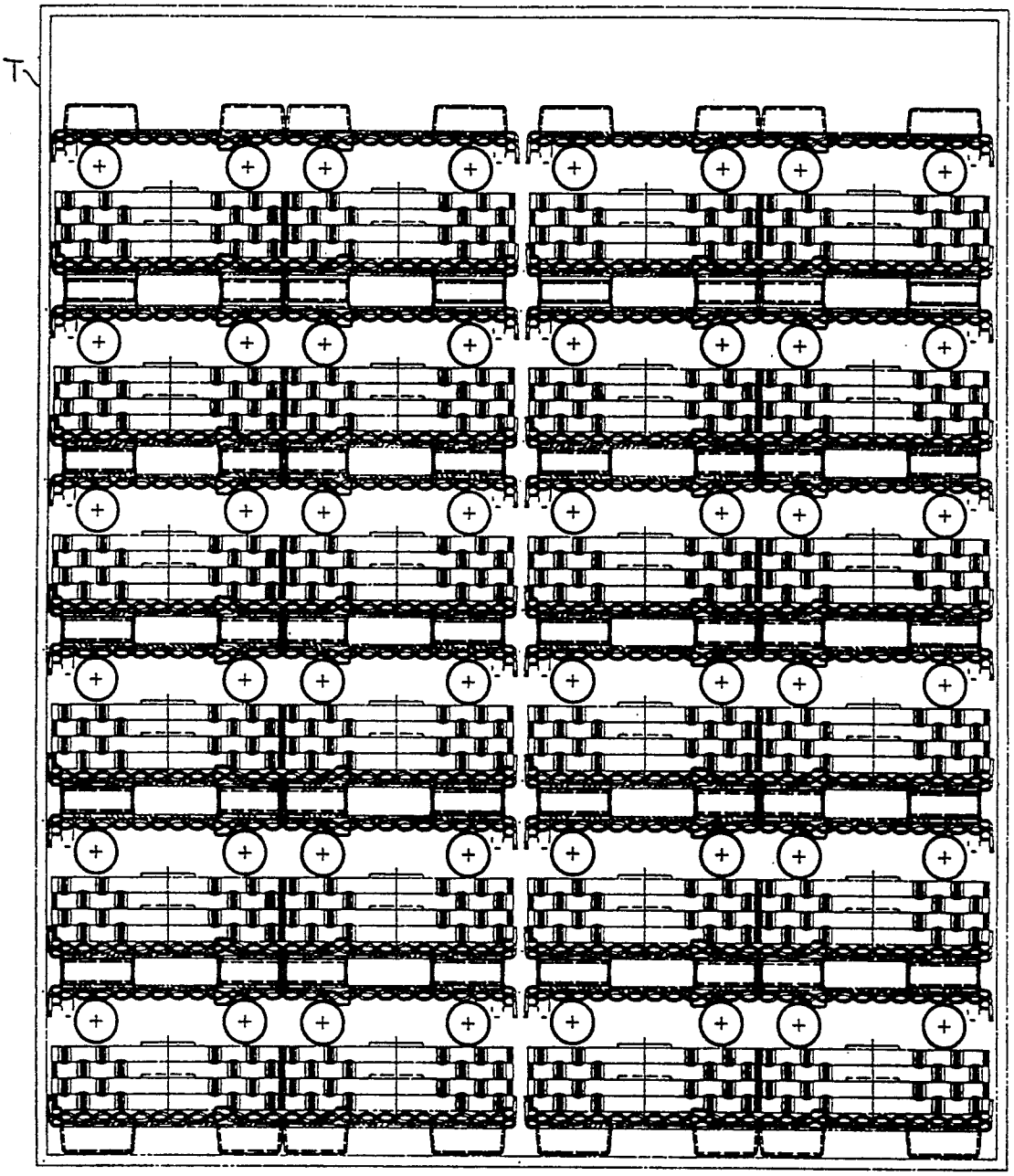
FIG. 35 is an end view similar to FIG. 33 but shows how the same standard truck-trailer is capable of returning twelve of the empty four roll modules per tier.
Figure 35:
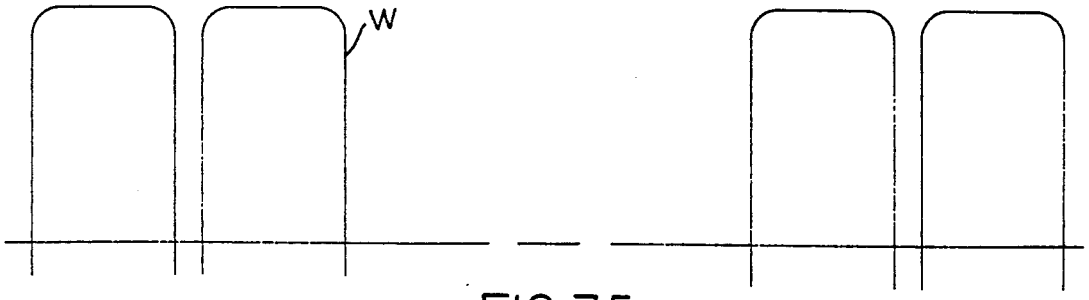

FIGS. 34 and 35 illustrate the same concepts for the four roll assembly module as shown in FIGS. 32 and 33 for the nine roll module.

What is claimed is:

1. An end cap adapted to be mounted on one end of a core upon which a length of flexible material may be wound, said end cap having a generally polygonal radially outer perimeter including an axially inner polygonal peripheral surface portion and an axially outer polygonal peripheral surface portion, said inner and outer polygonal peripheral surface portions of said end cap facing radially outwardly and extending at least throughout a portion of the perimeter thereof in an undulating pattern consisting of alternately outwardly bulging and inwardly recessed surface segments, said undulating axially inner and outer peripheral surface portions being off-set peripherally with respect to each other so that said bulging and recessed segments of one of said peripheral surface portions are non-aligned axially with respect to said bulging and recessed segments of the other, whereby two such end caps can be arranged in edge to edge contact with the bulging and recessed surface segments of said axially inner and outer peripheral surface portions interfitting with one another and with said outwardly bulging surface segments resisting relative axial movement therebetween.

2. An end cap as defined in claim 1, wherein said inner and outer peripheral surface portions of each end cap extend substantially continuously about the perimeter thereof.

3. An end cap as defined in claim 1, wherein said inner and outer peripheral surface portions extend about the perimeter of said end cap in an interrupted pattern of peripherally spaced sections.

4. An end cap as defined in claim 1, wherein said perimeter of said end cap is rectangular.

5. An end cap as defined in claim 1, wherein said perimeter of said end cap is square.

6. An end cap as defined in claim 1, wherein said perimeter of said end cap is octagonal and said undulating pattern of said peripheral surface portions extends along at least alternate edges of said end cap.

7. An end cap as defined in claim 1, wherein said bulging and recessed surface segments are of arcuate form and blend together in a generally sine-wave configuration.

8. An end cap as defined in claim 1, wherein said bulging and recessed surface segments are composed of angularly related, straight sections connected end to end.

9. An end cap as defined in claim 1, wherein said perimeter of said end cap is square, and said bulging and recessed surface segments are of arcuate form and blend together in a generally sine-wave configuration.

10. An end cap as defined in claim 1, wherein said inner and outer peripheral surface portions of said end cap are substantially 180° out of phase with each other with the bulging and recessed segments of said inner peripheral surface portion respectively aligned with the recessed and bulging segments of said outer peripheral surface portion.

11. An end cap as defined in claim 10, wherein said bulging and recessed surface segments of said inner peripheral surface portion are connected to said recessed and bulging surface segments, respectively, of said outer peripheral surface portion by linking surfaces disposed at a substantial angle to the axis of said end cap.

12. A roll for a length of flexible material comprising an elongated core, an end cap on each end of said core extending radially outwardly therefrom, each end cap having a generally polygonal radially outer perimeter including an axially inner polygonal peripheral surface portion and an axially outer polygonal peripheral surface portion, said inner and outer polygonal peripheral surface portions of each end cap facing radially outwardly and extending at least throughout a portion of the perimeter thereof in an undulating pattern consisting of alternately outwardly bulging and inwardly recessed surface segments, said undulating axially inner and outer peripheral surface portions of each end cap being off-set peripherally with respect to each other so that said bulging and recessed segments of one of said peripheral surface portions are non-aligned axially with respect to said bulging and recessed segments of the other, whereby two rolls as defined can be arranged adjacent to one another in positions such that their cores are parallel and the end caps at each end of said cores are in edge to edge contact with the bulging and recessed surface segments of said axially inner and outer peripheral surface portions interfitting with one another and with said outwardly bulging surface segments resisting relative axial movement therebetween.

13. A roll as defined in claim 12, wherein said inner and outer peripheral surface portions of each end cap extend substantially continuously about the perimeter thereof.

14. A roll as defined in claim 12, wherein said inner and outer peripheral surface portions of each end cap extend about the periphery thereof in an interrupted pattern of peripherally spaced sections.

15. A roll as defined in claim 12, wherein said perimeters of said end caps are rectangular.

16. A roll as defined in claim 12, wherein said perimeters of said end caps are square.

17. A roll as defined in claim 12, wherein said perimeter of each end cap is octagonal and said undulating pattern of said peripheral surface portions extends along at least alternate edges thereof.

18. A roll as defined in claim 12, wherein said bulging and recessed surface segments are of arcuate form and blend together in a generally sine-wave configuration.

19. A roll as defined in claim 12, wherein said bulging and recessed surface segments are composed of angularly related, straight sections connected end to end.

20. A roll as defined in claim 12, wherein one end cap has an axially extending part telescoping with a part at one end of said core, the outer one of the telescoping parts having diametrically opposed slots and the inner one of the telescoping parts having recesses registering with said slots, and a releasable locking device having locking elements projecting into said recesses through said slots to releasably secure said one end cap to said core.

21. A roll as defined in claim 20, wherein said locking device includes laterally spaced legs having first portions of relatively small cross-section adjacent one end constituting said locking elements and second portions adjacent the opposite end of sufficiently larger cross-section than said first portions to be incapable of projecting into said recesses, said locking device being adapted to slide in one direction to place said first portions of said legs in register with said slots and recesses and in the opposite direction to place said second portions of said legs in register with said slots and recesses.

22. A roll as defined in claim 12, wherein said perimeter of each said end cap is square, and said bulging and recessed surface segments are of arcuate form and blend together in a generally sine-wave configuration.

23. A roll as defined in claim 12, wherein said inner and outer peripheral surface portions of each end cap are substantially 180° out of phase with each other with said bulging and recessed segments of said inner peripheral surface portion respectively aligned with said recessed and bulging segments of said outer peripheral surface portion.

24. A roll as defined in claim 12, wherein said bulging and recessed surface segments of said inner peripheral surface portion of each end cap are connected to said recessed and bulging surface segments, respectively, of said outer peripheral surface portion by linking surfaces disposed at a substantial angle to the axis of said end caps.

25. A roll as defined in claim 12, wherein one of said caps has a central opening receiving one end of said core, an abutment on said core spaced from said one end thereof, and a retainer releasably secured on said one end of said core and clamping said end cap against said abutment.

26. A roll as defined in claim 25, wherein said core has an annular groove and said abutment is a snap ring seated in said groove.

27. A roll as defined in claim 12, wherein a collar is secured on one end of said core, said collar having an annular abutment at the end thereof remote from said one end of said core, one of said end caps has a central opening receiving said collar and in contact with said abutment, and a retainer releasably secured on said collar and clamping said one end cap against said abutment.

28. A roll as defined in claim 12, wherein said core is rotatably connected to said end caps to facilitate the removal of material wound on said core.

29. A module of rolls for a length of flexible material, each said roll comprising an elongated core, an end cap on each end of said core extending radially outwardly therefrom, each end cap having a generally polygonal radially outer perimeter including an axially inner polygonal peripheral surface portion and an axially outer polygonal peripheral surface portion, said inner and outer polygonal peripheral surface portions of each end cap facing radially outwardly and extending at least throughout a portion of the perimeter thereof in an undulating pattern consisting of alternately outwardly bulging and inwardly recessed surface segments, said undulating axially inner and outer peripheral surface portions of each end cap being off-set peripherally with respect to each other so that said bulging and recessed segments of one of said peripheral surface portions are non-aligned axially with respect to said bulging and recessed segments of the other, said module of rolls being so arranged that their cores are parallel and the end caps at each end of adjacent cores are in edge to edge contact with the bulging and recessed surface segments of said axially inner and outer peripheral surface portions interfitting with one another and with said outwardly bulging surface segments resisting relative axial movement therebetween.

30. A module of rolls as defined in claim 29, wherein said module comprises at least two rolls with the end caps of said rolls in edge to edge contact as aforesaid.

31. A module of rolls as defined in claim 29, wherein said module comprises at least two rows of rolls with at least two rolls in each row in edge to edge contact as aforesaid, said rows of rolls being stacked one upon another with the end caps of rolls in said two rows in edge to edge contact as aforesaid.

32. A module of rolls as defined in claim 29, wherein said perimeters of said end caps are rectangular.

33. A module as defined in claim 29, wherein said bulging and recessed surface segments are of arcuate form and blend together in a generally sine-wave configuration.

34. A module of rolls as defined in claim 29, wherein said module of rolls is supported on a bottom pallet and covered by a top pallet, and means for binding said module of rolls and pallets together.

35. A module of rolls as defined in claim 34, wherein said top and bottom pallets each have on the side facing the other pallet elongated surface strips spaced apart the same distance as the end caps on the ends of a core, said surface strips on said top and bottom pallets confronting one another to provide two sets of confronting strips, each strip including a laterally inner surface portion and a laterally outer surface portion, said laterally inner and outer surface portions extending substantially throughout the length of said strips in an undulating pattern matching that of said axially inner and outer peripheral surface portions of said end caps and engaging and interfitting therewith.

36. A module of rolls as defined in claim 35, wherein said end caps of each roll are removably secured to the core thereof, whereby, after the material is removed from said rolls, said cores and end caps can be separated and combined with said pallets to form a compact return package in which said pallets are arranged with said surface strips thereof in confronting relation to one another to provide two sets of confronting strips, said cores are arranged in parallel relation to one another extending between and at right angles to said strips, some of said end caps are arranged in a plurality of stacks confined between said pallets on opposite sides of said cores to prevent lateral movement of said cores, and the remaining end caps are arranged with their axially inner and outer peripheral surface portions engaging and interfitting with said laterally inner and outer surface portions of said strips.

37. A module of rolls as defined in claim 34, wherein said end caps of each roll are removably secured to the core thereof, whereby, after the material is removed from said rolls, said cores and end caps can be separated and combined with said pallets to form a compact return package in which said pallets are arranged in opposed, parallel relation, at least some of said end caps are arranged in a plurality of stacks between said pallets, and said cores are arranged in parallel relation confined between said stacks of end caps and said pallets.

* * * * *